US005689236A

United States Patent [19]

Kister

[11] Patent Number: 5,689,236

[45] Date of Patent: Nov. 18, 1997

[54] REMOTE GARAGE DOOR POSITION INDICATOR

[76] Inventor: Candie Kister, 2222 Tortuga St., Acton, Calif. 93510

[21] Appl. No.: 695,114

[22] Filed: Aug. 8, 1996

[51] Int. Cl.[6] ..... G08B 13/08

[52] U.S. Cl. ..... 340/545; 340/547; 340/552; 340/551; 340/550; 340/539; 340/686

[58] Field of Search ..... 340/547, 557, 340/539, 586, 552, 551, 550, 545

[56] References Cited

U.S. PATENT DOCUMENTS

| | | | |
|---|---|---|---|
| 3,641,540 | 2/1972 | Cutler et al. | 340/547 |
| 3,973,357 | 8/1976 | Kluempers | 340/547 |
| 3,975,723 | 8/1976 | Bowling et al. | 340/547 |
| 4,092,636 | 5/1978 | Shepherd, Jr. | 340/545 |
| 4,287,512 | 9/1981 | Combs | 340/542 |
| 4,427,975 | 1/1984 | Kinzie | 340/547 |
| 4,516,114 | 5/1985 | Cook | 340/542 |
| 4,593,491 | 6/1986 | Carlson et al. | 340/547 |
| 4,661,805 | 4/1987 | Salzer | 340/545 |
| 4,908,604 | 3/1990 | Jacob | 340/539 |
| 4,954,810 | 9/1990 | Llewellyn | 340/545 |
| 5,402,105 | 3/1995 | Doyle et al. | 340/539 |
| 5,444,440 | 8/1995 | Heydendahl | 340/825.32 |

*Primary Examiner*—Jeffery Hofsass
*Assistant Examiner*—Benjamin C. Lee

[57] ABSTRACT

A remote garage door position indicator comprises a magnetic sensor device; a transmitter device being operatively coupled to the magnetic sensor device, the transmitter device being capable of transmitting electronic signals; a signal interruption device including a plate extending therefrom, in closed orientation the outer plate of the receiver device engaging the magnetic sensors of the sensor device thereby closing the electrical circuit and causing the transmitter device to cease sending electronic signals; and a garage door position indicator including a power source and a light, the position indicator including a receiver means capable of receiving electronic signals from the transmitter device, when receiving electronic signals from the transmitter the receiver device causing the light to illuminate, in the closed orientation the transmitter device does not emit electronic signals thereby preventing the receiver device from illuminating the light, users viewing the light of the position indicator to determine whether their garage door is opened or closed.

1 Claim, 3 Drawing Sheets

REMOTE GARAGE DOOR POSITION INDICATOR

BACKGROUND OF THE INVENTION

1. Field of the Invention

The present invention relates to a remote garage door position indicator and more particularly pertains to indicating whether a user's garage door is closed.

2. Description of the Prior Art

The use of garage door openers is known in the prior art. More specifically, garage door openers heretofore devised and utilized for the purpose of opening and closing garage doors are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,402,105 to Doyle discloses a garage door position indicating system.

U.S. Pat. No. 4,583,081 to Schmitz discloses a status indicator system for a radio/dash control operator.

U.S. Pat. No. 4,035,702 to Pettersen discloses an electronic garage door opener safety device.

U.S. Pat. No. 5,315,953 to Mutlarkey, Jr. discloses a parking and door status indicator for a garage.

U.S. Pat. No. 4,496,942 to Matsuoka discloses a method and apparatus for door operation remote control.

Lastly, U.S. Pat. No. 4,218,681 to Hormann discloses a hand-held transmitter for transmitting different signals.

While these devices fulfill their respective, particular objective and requirements, the aforementioned patents do not describe a remote garage door position indicator for indicating whether a user's garage door is closed.

In this respect, the remote garage door position indicator according to the present invention substantially departs from the conventional concepts and designs of the prior art, and in doing so provides an apparatus primarily developed for the purpose of indicating whether a user's garage door is closed.

Therefore, it can be appreciated that there exists a continuing need for new and improved remote garage door position indicator which can be used for indicating whether a user's garage door is closed. In this regard, the present invention substantially fulfills this need.

SUMMARY OF THE INVENTION

In the view of the foregoing disadvantages inherent in the known types of garage door openers now present in the prior art, the present invention provides an improved remote garage door position indicator. As such, the general purpose of the present invention, which will be described subsequently in greater detail, is to provide a new and improved remote garage door position indicator and method which has all the advantages of the prior art and none of the disadvantages.

To attain this, the present invention essentially comprises a new and improved remote garage door position indicator comprising, in combination: an automatic garage door and garage door frame, the garage door and garage door frame each having a lower extent; a sensor device including a planar rectangular plate with two circular apertures positioned therethrough, a circular shaped magnetic sensor being positioned through each circular aperture, in an operative orientation the sensor plate being coupled to the lower extent of the garage door frame with a plurality of screws; a transmitter device being positioned adjacent to the garage door frame, the transmitter device being electrically powered and operatively coupled to the magnetic sensors by a pair of electrical wires, the transmitter device including means to transmit electronic signals; a signal interruption device including an inner plate and an outer plate, the inner plate being affixed to the garage door adjacent to it's lower most extent, the inner plate including a central recess with a spherical inner end and a cylindrical outer end, the outer plate being formed in a generally planar rectangular configuration with an inner surface including a projection member extending therefrom, the projection member having a spherical outboard section and a cylindrical inboard section, the outer plate adapted to be coupled to the inner plate by coupling the projection member within the recess, the configuration of the projection member and recess being such that in a coupled orientation the outer plate extends a short distance from the inner plate, in closed orientation the outer plate of the receiver device engaging the magnetic sensors of the sensor device thereby closing the electrical circuit and causing the transmitter device to cease sending electronic signals; and a garage door position indicator formed in a generally rectangular configuration and including a power source and a light, the position indicator including receiver means capable of receiving electronic signals from the transmitter device, the receiver means being operatively coupled to the power source and light, when receiving electronic signals from the transmitter the receiver means causing the light to illuminate, in the closed orientation the transmitter device does not emit electronic signals thereby preventing the receiver means from illuminating the light, users viewing the light of the position indicator to determine whether their garage door is opened or closed.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved remote garage door position indicator which has all the advantages of the prior art garage door openers and none of the disadvantages.

It is another object of the present invention to provide a new and improved remote garage door position indicator which may be easily and efficiently manufactured and marketed.

It is a further object of the present invention to provide a new and improved remote garage door position indicator which is of durable and reliable construction.

An even further object of the present invention is to provide a new and improved remote garage door position indicator which is susceptible of a low cost of manufacture with regard to both materials and labor, and which accordingly is then susceptible of low prices of sale to the consuming public, thereby making such a remote garage door position indicator economically available to the buying public.

Even still another object of the present invention is to provide a new and improved remote garage door position indicator for indicating whether a user's garage door is closed.

Lastly, it is an object of the present invention to provide a new and improved remote garage door position indicator comprising: a magnetic sensor device; a transmitter device being operatively coupled to the magnetic sensor device, the transmitter device being capable of transmitting electronic signals; a signal interruption device including a plate extending therefrom, in closed orientation the outer plate of the receiver device engaging the magnetic sensors of the sensor device thereby closing the electrical circuit and causing the transmitter device to cease sending electronic signals; and a garage door position indicator including a power source and a light, the position indicator including a receiver means capable of receiving electronic signals from the transmitter device, when receiving electronic signals from the transmitter the receiver device causing the light to illuminate, in the closed orientation the transmitter device does not emit electronic signals thereby preventing the receiver device from illuminating the light, users viewing the light of the position indicator to determine whether their garage door is opened or closed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
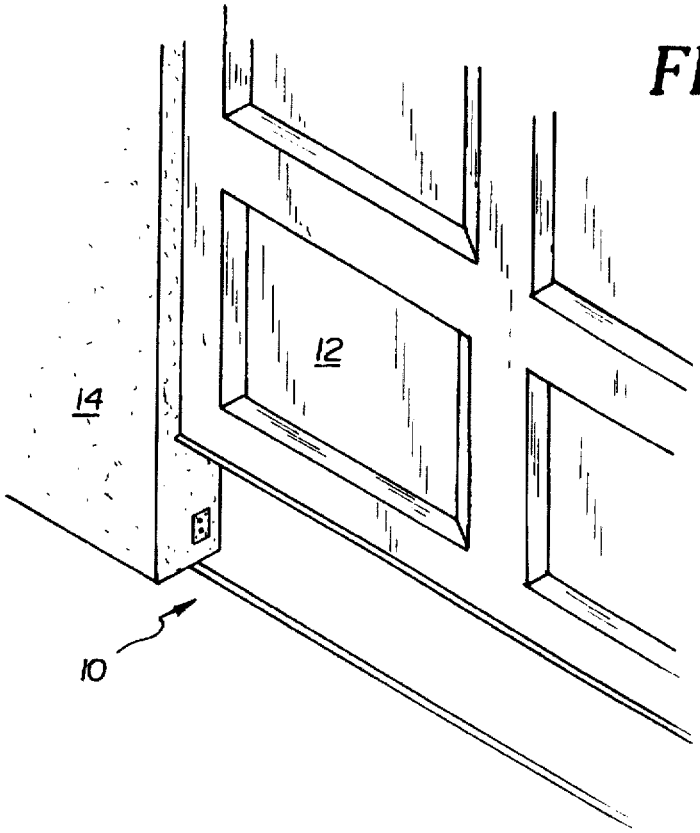
FIG. 1 is a perspective view of the preferred embodiment of the remote garage door position indicator constructed in accordance with the principles of the present invention.

With reference now to the drawings, and in particular, to FIG. 1 thereof, the preferred embodiment of the new and improved remote garage door position indicator embodying the principles and concepts of the present invention and generally designated by the reference number 10 will be described.

Specifically, it will be noted in the various Figures that the device relates to a remote garage door position indicator. In its broadest context, the device consists of an automatic garage door 12, a garage door frame 14, a sensor device 16, a transmitter device 18, a signal interruption device 20 and a garage door position indicator 22. Such components are individually configured and correlated with respect to each other so as to attain the desired objective.

The automatic garage door 12 is formed in a generally planar rectangular configuration and is vertically retractable. The garage door frame 14 is positioned around the perimeter of the opening to the garage. The garage door and garage door frame each have a lower extent. When the garage door is closed the lower extent of a side edge of the garage door abuts the lower extent of the garage door frame. Note FIG. 1.

The sensor device 16 includes a planar rectangular plate with two circular apertures positioned through it. The plate has four corners each including a screw hole. A circular shaped magnetic sensor 26 is positioned through each circular aperture. The sensor plate is coupled to the lower extent of the garage door frame with a plurality of screws.

Figure 3:
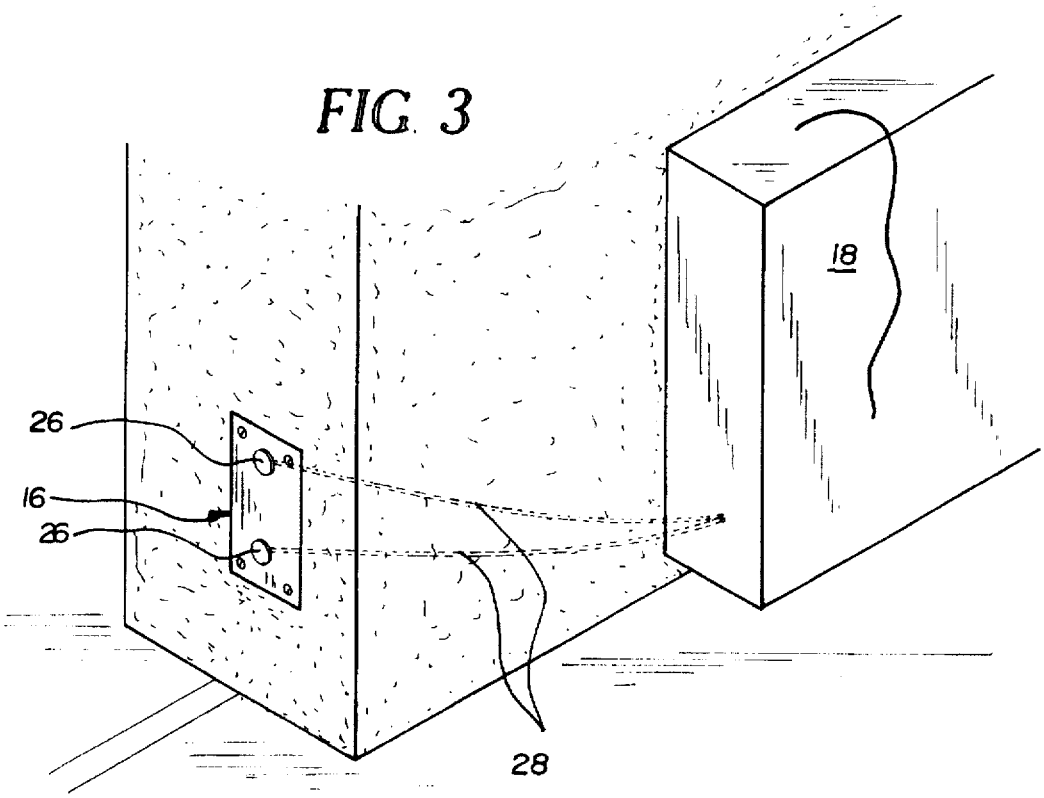
FIG. 3 is a partially broken away enlarged perspective view illustrating the magnetic sensor and transmitter of the apparatus.

The transmitter device 18 is positioned adjacent to the garage door frame. The transmitter device is electrically powered and operatively coupled to the magnetic sensors by a pair of electrical wires 28. In varying embodiments the transmitter device 18 is powered by batteries or household current. The transmitter device includes means to transmit electronic signals to the garage door position indicator 22. Note FIG. 3.

Figure 5:
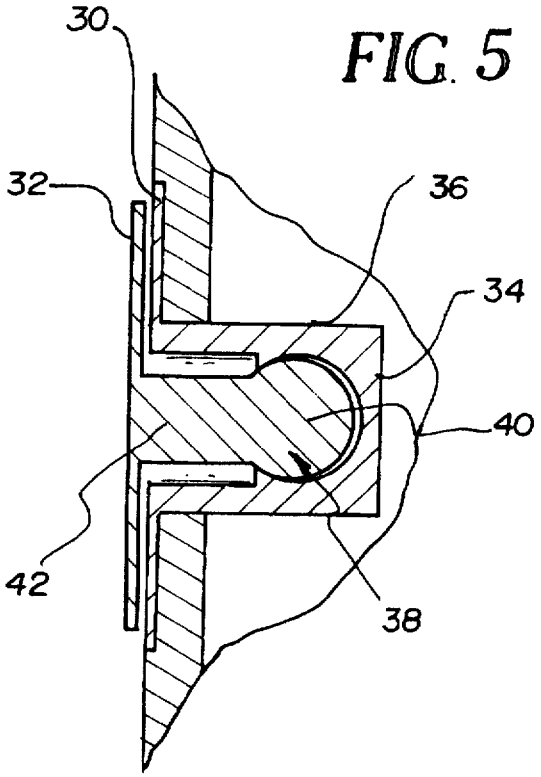
FIG. 5 is a cross sectional view taken along section line 5—5 of FIG. 4.
Figure 4:
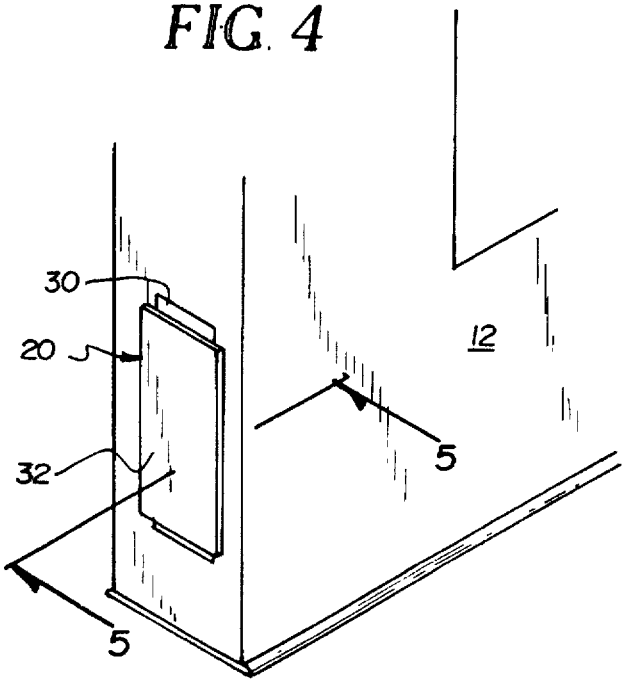
FIG. 4 is an enlarged perspective view illustrating the configuration of the metal plate of the apparatus.

A signal interruption device 20 includes an inner plate 30 and an outer plate 32. The inner plate is affixed to the lower extent of a side edge of the garage door. The inner plate includes a central recess with a spherical inner end 34 and a cylindrical outer end 36. The outer plate is formed in a generally planar rectangular configuration with an inner surface which includes a projection member 38 extending from it. The projection member has a spherical outboard section 40 and a cylindrical inboard section 42. The outer plate is couplable to the inner plate by coupling the projection member within the recess. Note FIGS. 4 and 5.

Figure 2:
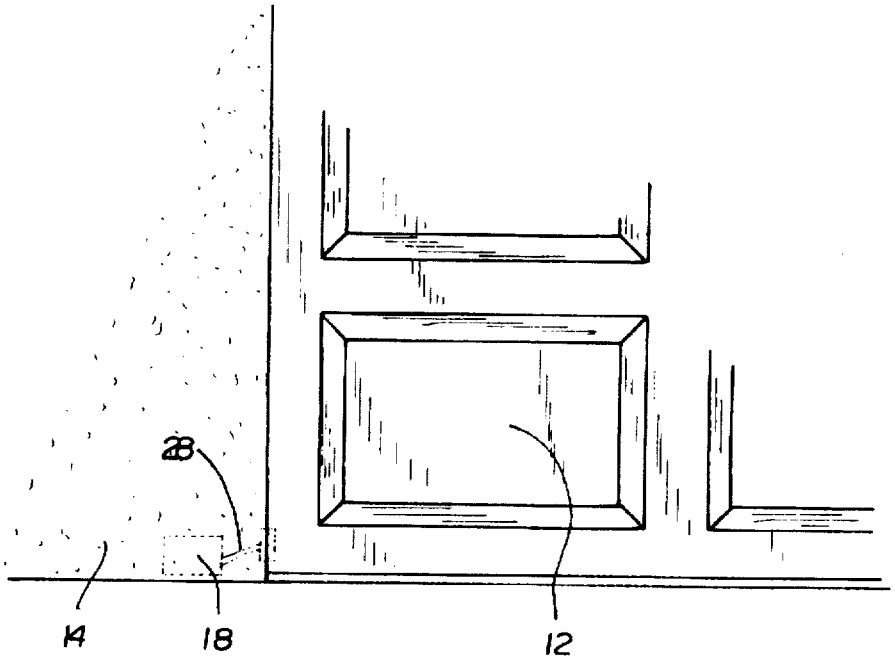
FIG. 2 is a partially broken away perspective view illustrating the positioning of the transmitter and sensor of the apparatus.

The configuration of the projection member and recess are such that in a coupled orientation the outer plate extends a short distance from the inner plate. The short distance separating the plates bridges the separation between the garage door and garage door frame. In a closed orientation the outer plate of the receiver device engages the magnetic sensors of the sensor device thereby closing the electrical circuit and causing the transmitter device 18 to cease sending electronic signals. Transmission range of the transmitter device is about 100 miles. Note FIGS. 2, 4 and 5.

Figure 6:
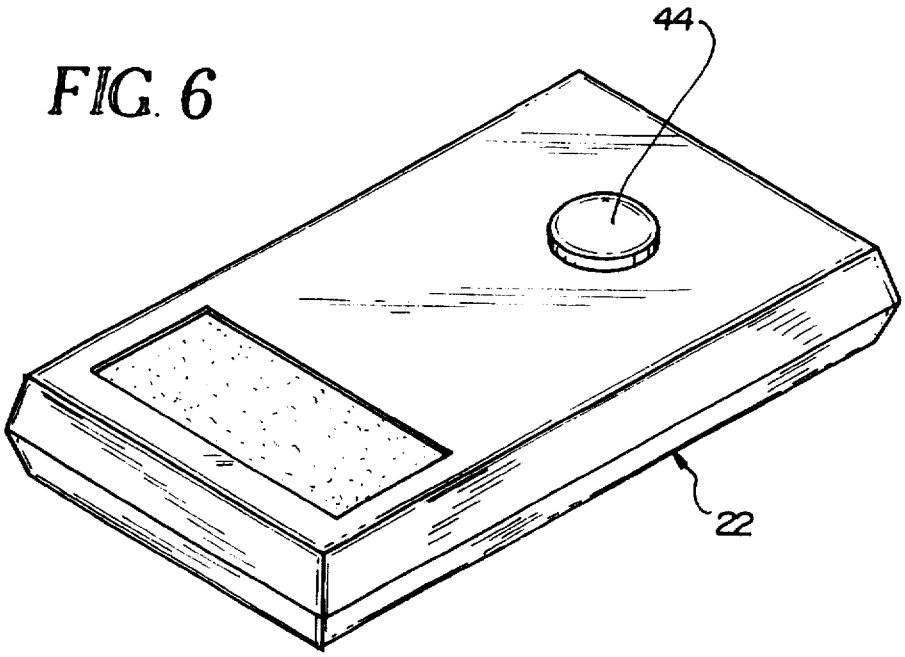
FIG. 6 is a perspective view of the garage door opener of the apparatus.

The garage door position indicator 22 is formed in a generally rectangular configuration and includes a power source and a light 44. The power source is conventional batteries. The position indicator includes receiver means capable of receiving electronic signals from the transmitter device. The receiver means are operatively coupled to the power source and light. When receiving electronic signals from the transmitter the receiver means causes the light to illuminate. In the closed orientation the transmitter device does not emit electronic signals thereby preventing the receiver means from illuminating the light. Note FIG. 6.

Users view the light of the position indicator to determine whether their garage door is opened or closed. This apparatus is particularly useful when the user is away from home and does not remember if they shut their garage door. If the light on the position indicator is off, the user is reassured that they did indeed shut their garage door. If the light on the position indicator is on, the user is alerted that their garage door is open. The user may then take the necessary remedial measures such as calling a neighbor or driving home to shut the garage door. Note FIGS. 1 and 2.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A remote garage door position indicating system comprising, in combination:

an automatic garage door and garage door frame formed in a generally rectangular configuration, the garage door and garage door frame each having a lower extent, the garage door being vertically retractable, wherein the garage door is in a closed orientation when the lower extent of the garage door abuts the lower extent of the garage door frame;

a sensor device including a planar rectangular plate with two circular apertures positioned therethrough, a circular shaped magnetic sensor being positioned through each circular aperture, in an operative orientation the sensor plate being coupled to the lower extent of the garage door frame with a plurality of screws;

a transmitter device having a range of 100 miles being positioned adjacent to the garage door frame, the transmitter device being electrically powered and operatively coupled to the magnetic sensors by a pair of electrical wires, the transmitter device including means to transmit electronic signals;

a signal interruption device including an inner plate and an outer plate, the inner plate being affixed to the garage door adjacent to it's lower most extent, the inner plate including a central recess with a spherical inner end and a cylindrical outer end, the outer plate being formed in a generally planar rectangular configuration with an inner surface including a projection member extending therefrom, the projection member having a spherical outboard section and a cylindrical inboard section, the outer plate adapted to be coupled to the inner plate by coupling the projection member within the recess, the configuration of the projection member and recess being such that in a coupled orientation the outer plate extends a short distance from the inner plate, in closed orientation the outer plate of signal interruption device engaging the magnetic sensors of the sensor device thereby closing the electrical circuit and causing the transmitter device to cease sending electronic signals; and a garage door position indicator formed in a generally rectangular configuration and including a power source and a light, the position indicator including receiver means capable of receiving electronic signals from the transmitter device, the receiver means being operatively coupled to the power source and light, when receiving electronic signals from the transmitter the receiver means causing the light to illuminate, in the closed orientation the transmitter device does not emit electronic signals thereby preventing the receiver means from illuminating the light, users viewing the light of the position indicator to determine whether their garage door is opened or closed.

* * * * *